United States Patent [19]

Sweany

[11] 4,115,246

[45] Sep. 19, 1978

[54] OIL CONVERSION PROCESS

[75] Inventor: Glenn A. Sweany, Ponca City, Okla.

[73] Assignee: Continental Oil Company, Ponca City, Okla.

[21] Appl. No.: 764,123

[22] Filed: Jan. 31, 1977

[51] Int. Cl.[2] ..... C10G 13/00

[52] U.S. Cl. ..... 208/56; 208/58

[58] Field of Search ..... 208/56

[56] References Cited

U.S. PATENT DOCUMENTS

| | | | |
|---|---|---|---|
| 2,847,306 | 8/1958 | Stewart et al. | 208/56 |
| 2,953,513 | 9/1960 | Langer | 208/56 |
| 3,617,513 | 11/1971 | Wilson et al. | 208/56 |
| 4,039,429 | 8/1977 | Van Klinken et al. | 208/61 |

OTHER PUBLICATIONS

Singer et al., "Chemical Engineering Progress", vol. 57, No. 7, (Jul. 1961) pp. 68 to 74.

*Primary Examiner*—Herbert Levine
*Attorney, Agent, or Firm*—Richard W. Collins

[57] ABSTRACT

A hydrogen donor diluent cracking process for upgrading a heavy liquid hydrocarbon wherein pitch fractionated from the cracked products is subjected to a partial oxidation process to reduce the amount of pitch and to provide hydrogen for hydrogenation of hydrogen donor diluent for the cracking step.

8 Claims, 2 Drawing Figures

OIL CONVERSION PROCESS

BACKGROUND OF THE INVENTION

1. Field of the Invention

This invention relates to a process for upgrading heavy hydrocarbon oils, and more particularly to improvements in the hydrogen donor diluent cracking process for converting heavy oils such as vacuum residua from a petroleum refinery, coal extracts, oil from oil shale and bitumen from tar sands to more valuable lighter liquid distillates by thermally cracking the heavy oils in the presence of a hydrogen donor diluent.

2. Brief Description of the Prior Art

The hydrogen donor diluent cracking process in which certain low value hydrocarbon fractions are upgraded by thermal cracking in the presence of a hydrogen donor diluent is described in detail in U.S. Pat. No. 2,953,513. Process variables and operating conditions for the hydrogen donor diluent cracking process are discussed at length in that patent. One disadvantage of the conventional hydrogen donor diluent cracking process is that fractionation of the product stream from the cracking step produces a heavy bottoms or pitch stream which is of low value relative to the other products from the process and in some cases presents a disposal problem. A portion of this heavy pitch material may be recycled through the process, but as a practical matter a substantial purge is usually required in order to operate the process continuously in an efficient manner. A second disadvantage of the conventional hydrogen donor diluent cracking process is the requirement of a substantial amount of expensive hydrogen for hydrogenation of the donor solvent. The process of the present invention overcomes both of the aforementioned disadvantages, and provides a more efficient and more environmentally-acceptable process.

It is known in the art that hydrogen-rich reducing gases can be prepared by a non-catalytic controlled partial oxidation of hydrocarbon materials. Such a process is described in detail in Chemical Engineering Progress, Volume 57, No. 7, pp. 68–74. As described in that article, the oxidizing gas may be air, oxygen, or enriched air. The products from the partial oxidation process consist largely of hydrogen and carbon monoxide, and if a substantially pure hydrogen stream is desired the carbon monoxide and hydrogen can be passed to a shift converter to produce additional hydrogen according to the well-known shift reaction.

It is further known in the art that hydrogen-containing gases produced from partial oxidation processes can be utilized in various hydrocarbon refining steps which require hydrogen. U.S. Pat. Nos. 2,847,306; 3,756,944 and 3,764,547 are exemplary of patents describing hydrocarbon processing steps in which a reducing gas obtained by partial oxidation of a hydrocarbon material is utilized in subsequent processing.

SUMMARY OF THE INVENTION

According to the present invention, the pitch fraction resulting from fractionation of the products of a hydrogen donor diluent cracking step is subjected to a partial oxidation process, and the resulting hydrogen-containing gas produced by the partial oxidation step is utilized to hydrogenate the recycle hydrogen donor solvent.

It is a feature of this invention that the disposal problem associated with the conventional hydrogen donor diluent cracking process is minimized, as the residue from partial oxidation of pitch in accordance with this invention is quite low, such as from about 1 to 3 percent based on the pitch fed to the partial oxidation step, depending upon process conditions, whereas the amount of heavy pitch which must be purged from the conventional process can amount to from 20 to 30 percent of the feed to the cracking furnace. While the pitch fraction is not completely without value, in many instances it is, nevertheless, an undesirable material.

It is a further feature of the present invention that the hydrogen required for hydrogenating the recycle donor solvent can be provided by the product gas stream resulting from partially oxidizing the pitch fraction. Thus, the process of the present invention not only minimizes the problems associated with production of heavy pitch material, but also provides an internal source of hydrogen for the process.

It is accordingly an object of the present invention to provide an improved hydrogen donor diluent cracking process.

It is a further object to provide such a process which minimizes the amount of material requiring special disposal procedures.

It is still a further object to provide such a process in which the hydrogen requirement for hydrogenation of recycled donor solvent can be generated internally.

The foregoing, as well as additional objects and advantages, are provided by the process of this invention as will be apparent from consideration of the following detailed description of the preferred embodiments.

DESCRIPTION OF THE PREFERRED EMBODIMENTS

Figure 1:
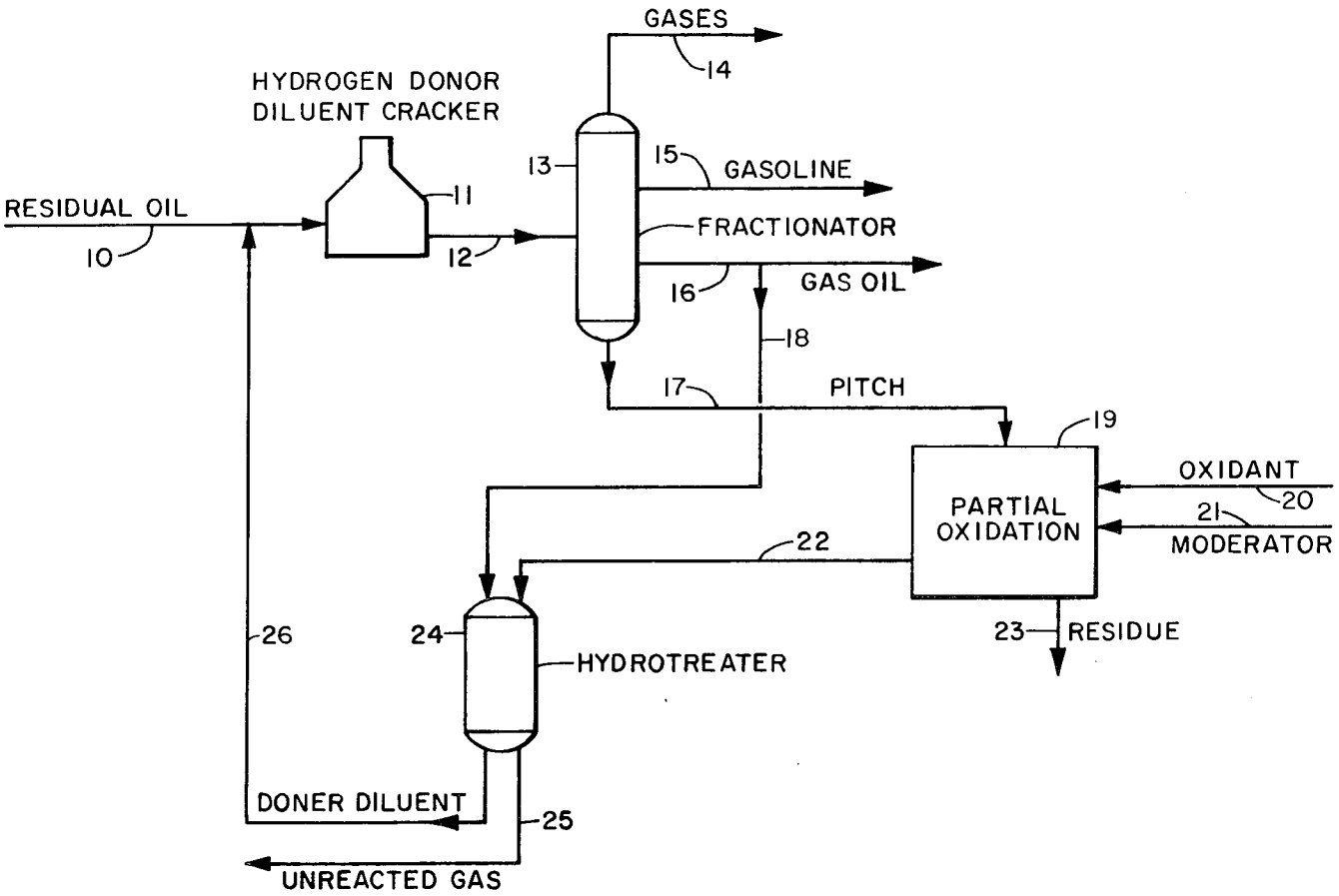
FIG. 1 is a schematic flow sheet illustrating the basic process of the invention.

The basic process in accordance with the preferred embodiment of the invention will be described generally by reference to FIG. 1 of the drawings. FIG. 1 shows a residual oil feed line 10 to a hydrogen donor diluent cracking furnace 11. Cracked products exit furnace 11 through line 12 to fractionator 13 where gases and light ends are removed through line 14, an intermediate fraction including a gasoline boiling range material is removed through line 15, a gas oil fraction is removed through line 16, and a pitch fraction is removed through line 17. Depending on operating conditions, a portion or all of the gas oil fraction, or of a particular boiling range cut thereof, is passed through line 18 to hydrotreater 24 where it is subjected to mild hydrotreating to provide a hydrogen-rich donor diluent which is returned via line 26 to feed line 10 for use as a hydrogen donor in the hydrogen donor diluent cracking step. As will be apparent, additional product fractions might be produced in fractionator 13 and removed through appropriate lines (not shown).

The pitch fraction from fractionator 13 is subjected to a partial oxidation step at 19 by reaction with an oxidant such as air, enriched air or oxygen from line 20 moderated by an inert gas moderator such as steam, nitrogen or carbon dioxide from line 21. The gases produced in the partial oxidation step, rich in hydrogen and carbon monoxide to varying degrees depending on operating conditions and whether air or oxygen is utilized as the oxidant, are passed through line 22 to hydrotreater 24 where the hydrogen therein is used to hydrotreat the gas oil and produce a hydrogenated donor diluent. Any excess hydrogen and unreacted gases pass from hydrotreater 24 through line 25 any may be used as fuel or otherwise utilized.

A residue from the partial oxidation step is taken through line 23 for disposal. Generally, the amount of residue will be quite small, such as less than three percent based on the pitch feed to the partial oxidation step. This residue contains most of the heavy metals such as vanadium and nickel from the feed to the process, and these metals can be recovered from the residue if economic conditions warrant.

Figure 2:
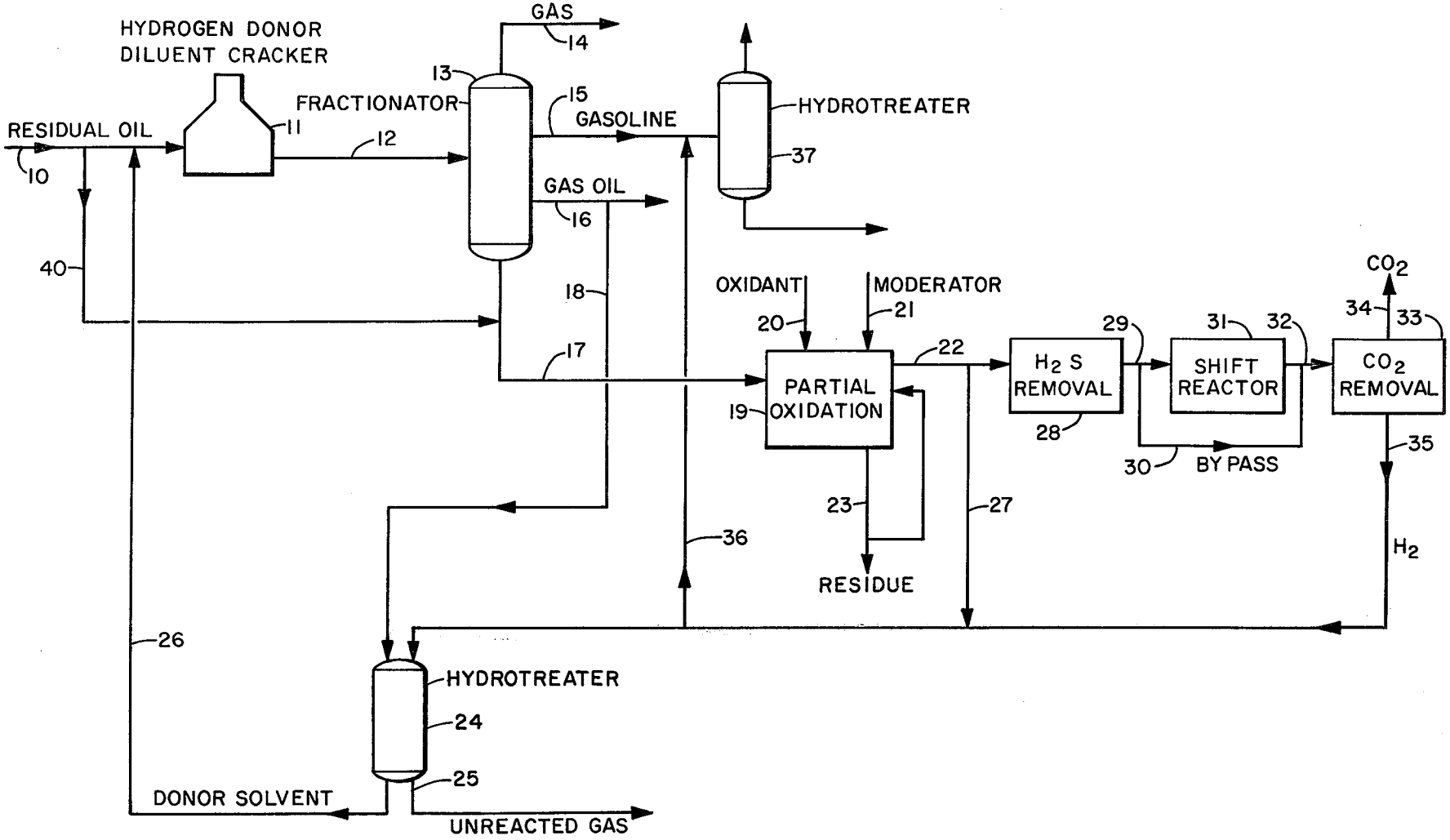
FIG. 2 is a schematic flowsheet showing a more complex variation of the process of the invention.

A more elaborate embodiment of the process of the invention is shown in FIG. 2. This process includes a cracking furnace 11, fractionator 13, partial oxidation step 19 and recycle donor hydrotreater 24 just as in the process of FIG. 1. However, the more complex process of FIG. 2 additionally includes provision for downstream processing of the product gas from the partial oxidation step to provide greater flexibility. A hydrogen sulfide reducing unit 28 is provided to reduce the hydrogen sulfide level in the product gas stream in the event that a relatively high sulfur feed is used in the cracking furnace, although this unit may not be required depending on sulfur content in the feed and the type of catalyst used in shift reactor 31 downstream from hydrogen sulfide reducer 28. Line 29 from hydrogen sulfide reducer 28 is provided with a bypass line 30 such that any or all of the gas from line 29 can be bypassed around shift reactor 31 to line 32. The acid gas scrubber unit 33 recovers carbon dioxide produced in reactor 31 and removes it through line 34. A hydrogen-rich product gas stream from scrubber 33 leads to hydrotreater 24. All or part of the gases from partial oxidation unit 19 may be passed directly to line 35 through bypass line 27, and a part of the hydrogen-rich gas from line 35 may be taken through line 36 and used to hydrotreat another product fraction from fractionator 13 in hydrotreater 37. It will be appreciated that additional bypasses (not shown) could be used around hydrogen sulfide reducer 28 and acid gas scrubber 33 depending on the details of the operation.

During startup or in cases where insufficient pitch is available to provide sufficient hydrogen for the hydrotreating step, fresh feed may be taken through line 40 directly to the partial oxidation step to supplement the pitch stream.

The essential feature of the invention is the provision of a partial oxidation treatment of the pitch fraction and utilization of hydrogen produced in the partial oxidation step to hydrotreat recycle donor solvent. The specific process conditions in the various steps of the process are more or less conventional, and are subject to considerable variation dependent on feedstock characteristics, product fractions desired, equipment capabilities, etc.

Hydrogen donor diluent cracking is normally carried out at a donor diluent to fresh feed ratio in the range of 0.1 to 5 volumes per volume, and preferably about an equal amount of donor diluent and fresh feed is used. A residence time of from 0.1 to 2.0 hours and a pressure of 10 to 50 kg/cm$^2$ is usually used.

The fresh feedstock to the cracking furnace may be shale oil, tar sand oil, coal tar extract or residual oil from a petroleum refinery, and preferably is a residual oil obtained by a conventional vacuum distillation of crude oil.

The pitch fraction from fractionator 13 is preferably the fraction boiling above about 500° C., and most preferably is the fraction boiling above about 535° C.

The preferred partial oxidation step is basically similar to that developed originally as a means of converting liquid fuels to hydrogen and carbon monoxide. This preferred partial oxidation process is based on the non-catalytic controlled partial oxidation of pitch obtained from fractionation of cracking products. The oxidant (oxygen or air) is preheated, mixed with already hot pitch, and reacted in a reactor maintained at about 7 to 9 kg/cm$^2$ and a temperature of about 1100° to 1500° C. When oxygen is used as the oxidant, the reaction must be moderated with steam and/or carbon dioxide. When air is used as the oxidant, the inert nitrogen from the air has a moderating effect, but it is usually desirable to provide for steam injection to be assured of adequate control of the reaction. Alternatively, the partial oxidation step can be carried out at near atmospheric pressure.

A partial oxidation process product gas stream will contain about 13 mole percent hydrogen and about 25 mole percent carbon monoxide when air is used as the oxidant. Much higher concentrations, such as 32 mole percent hydrogen and 58 mole percent carbon monoxide, may be obtained using oxygen as the oxidant. In either case, the hydrogen concentration can be increased by use of a shift convertor and acid gas scrubber.

It will be appreciated that specific process details of temperature, pressure, flow rates, product cuts, etc. may be varied considerably according to the specific requirements and other circumstances. The selection of specific operating conditions is readily determined by one skilled in the art, and does not constitute an essential part of the invention. The invention broadly lies in the discovery that the undesirable pitch fraction from the hydrogen donor diluent cracking process can be essentially eliminated by operating in accordance with the invention. Additionally, hydrogen for hydrotreating the donor solvent is provided.

I claim:

1. In a hydrogen donor diluent cracking process wherein heavy liquid hydrocarbon oil is charged to a thermal cracker and thermally cracked in the presence of a hydrogenated donor solvent, the thermally cracked material is fractionated to produce fractions comprising light ends, intermediate distillates, gas oil material and a pitch product boiling above 500° C., and wherein at least a part of the product gas oil material is hydrogenated and recycled to the thermal cracking step as hydrogen donor solvent, the improvement comprising:

subjecting a portion of the fresh hydrocarbon oil feed to the process and said pitch product after fractionation to a partial oxidation process thereby producing a product gas stream containing hydrogen, and utilizing said hydrogen to hydrogenate said hydrogen donor solvent for recycle to said thermal cracking step.

2. The process of claim 1 wherein said partial oxidation process is carried out utilizing air as the oxidizing gas.

3. The process of claim 1 wherein said partial oxidation process is carried out utilizing air enriched with oxygen as the oxidizing gas.

4. The process of claim 1 wherein said partial oxidation process is carried out utilizing oxygen as the oxidizing gas.

5. The process of claim 1 wherein said pitch product is a 535° C. + material.

6. The process of claim 1 wherein a portion of said product gas stream is utilized to hydrotreat material other than recycle donor solvent.

7. The process of claim 1 wherein at least a part of said product gas stream is subjected to a shift reaction whereby the hydrogen concentration of said product gas stream is increased.

8. The process of claim 1 wherein said hydrocarbon oil is a vacuum residual oil from a petroleum refinery.

* * * * *